US006293218B1

(12) United States Patent
White

(10) Patent No.: US 6,293,218 B1
(45) Date of Patent: Sep. 25, 2001

(54) TUNNEL-HULLED BOAT

(76) Inventor: Ralph Fern White, P.O. Box 314, Blountstown, FL (US) 32424

( * ) Notice: Subject to any disclaimer, the term of this patent is extended or adjusted under 35 U.S.C. 154(b) by 0 days.

(21) Appl. No.: 09/641,504

(22) Filed: Aug. 21, 2000

(51) Int. Cl.[7] ..... B63B 1/32
(52) U.S. Cl. ..... 114/288; 114/290
(58) Field of Search ..... 114/271, 283, 114/288, 289, 290

(56) References Cited

U.S. PATENT DOCUMENTS

| | | | | |
|---|---|---|---|---|
| Re. 33,165 | | 2/1990 | Whitehead | 440/69 |
| D. 334,011 | | 3/1993 | Biel et al. | D12/310 |
| D. 367,462 | | 2/1996 | Lorenzen | D12/310 |
| 3,289,623 | | 12/1966 | Gray et al. | 114/67 |
| 3,937,173 | | 2/1976 | Stuart | 115/39 |
| 4,091,761 | | 5/1978 | Fehn | 114/290 |
| 4,392,448 | | 7/1983 | Shirley | 114/271 |
| 4,652,245 | | 3/1987 | Mey | 440/69 |
| 4,685,889 | | 8/1987 | Nystrom | 440/69 |
| 4,689,026 | | 8/1987 | Small | 440/66 |
| 4,713,028 | | 12/1987 | Duff | 440/61 |
| 4,722,294 | * | 2/1988 | Bruning | 114/290 |
| 4,907,520 | | 3/1990 | Pipkorn . | |
| 4,915,668 | | 4/1990 | Hardy | 440/69 |
| 4,951,591 | | 8/1990 | Coles | 114/274 |
| 4,977,845 | | 12/1990 | Bundquist | 114/289 |
| 5,191,849 | | 3/1993 | Lubrucherie et al. . | |
| 5,249,994 | | 10/1993 | Finkl | 440/79 |
| 5,350,327 | | 9/1994 | Self et al. | 440/66 |
| 5,474,014 | | 12/1995 | Russell | 114/288 |
| 5,497,722 | | 3/1996 | English, Sr. | 114/62 |
| 5,570,650 | | 11/1996 | Hurley . | |
| 6,125,781 | * | 10/2000 | White | 114/288 |

* cited by examiner

*Primary Examiner*—Jesus D. Sotelo
(74) *Attorney, Agent, or Firm*—Peter Loffler

(57) ABSTRACT

A tunnel-hulled boat that has a high degree of maneuverability at low and high speeds with decreased hydrodynamic drag is disclosed. The tunnel-hulled boat is maneuverable in shallow water and when proceeding in reverse. The tunnel-hulled boat is comprised of a hull having a generally rounded tunnel that extends from proximate amidships to the aft with the depth of the tunnel increasing from its nose end to its aft end. The tunnel has a generally rounded twin entry nose and has a notched aft. A first set of bevels having increasing diameter extend along each side of the tunnel while a second set of bevels are each disposed within a respective one of the first set of bevels proximate the transom of the boat. A pair of sponsons are attached to the transom on each side of the tunnel.

13 Claims, 3 Drawing Sheets

TUNNEL-HULLED BOAT

BACKGROUND OF THE INVENTION

1. Field of the Invention

The present invention relates to a tunnel-hulled boat having a twin entry tunnel.

2. Background of the Prior Art

Tunnel-hulled boats are known in the art. By providing one or more tunnels within a boat's hull, the operating characteristics of the boat are improved. The particular nature of the tunnel is determined by the operational characteristics that are to be advanced. Various designs and considerations have been taught with varying degrees of achievement. However, no prior art design has disclosed a tunnel-hulled boat design that greatly improves the operating characteristics of the boat in most modes of operation including fast speed, slow speed, gradual and sharp turning, shallow water operation, and backing procedures, or in most water conditions.

Therefore, there is a need in the art for a tunnel-hulled boat that improves the operating characteristics of the boat in most modes of operation and under various sea conditions. Such a tunnel-hulled boat should be of relatively simple and straightforward design employing standard methods of manufacture to build.

SUMMARY THE INVENTION

The tunnel-hulled boat of the present invention addresses the aforementioned needs in the art. The present invention provides for a tunnel-hulled boat that improves the operating characteristics of a boat at fast speeds and at slow speeds and in gradual as well as sharp turns. The present invention allows the boat to achieve strong performance characteristics in shallow water as well as during backing procedures. These performance improvements are achieved under various sea conditions. The tunnel-hulled boat is not unduly complex in design and is constructed using standard manufacturing techniques.

The tunnel-hulled boat of the present invention is comprised of a hull having a fore, an amidships, and an aft with a transom attached thereto proximate the aft. A generally rounded tunnel, having a generally rounded twin-entry nose and a pair of opposing sides with a first bevel on each side, is disposed within the hull extending rearwardly from the amidships. The depth of the tunnel increases during the rearward progression. The diameter of each bevel increases during rearward progression and a second bevel is disposed within each first bevel proximate the aft. The rearward portion of the tunnel has a generally V-shaped notch. A pair of sponsons, each having a diagonal end relative to the amidships of the hull, is attached to the transon on opposing sides of the tunnel. The combined buoyancy volume of the sponsons is greater than the buoyancy volume loss of the tunnel. A pair of lifting strakes, each having two sections disposed on different planes relative to one another, is located on the hull on opposing sides of the tunnel.

In operation, water enters the tunnel by passing over the twin entry nose which causes the water to enter the tunnel in two separate and parallel paths thereby increasing the stability of the boat especially at high operational speeds. The increasing depth of the tunnel behind the bulbed portion maintains straight flow of water through the tunnel further increasing boat stability. Both of these factors decrease water flow turbulence through the tunnel thereby decreasing hydrodynamic drag and increasing performance. The bevels assist in turning at low and high speeds with the increasing nature of the diameter of the first bevels helping deflect the water during the turn thereby increasing boat stability. Furthermore, the second set of bevels channel water to the first set of bevels during a backing operation thereby increasing the efficiency of the maneuver. The notch at the rear of the tunnel allows water to rise to furnish sufficient cooling water for motors without low water intakes. The sponsons replace the buoyancy volume lost to the tunnel to allow proper operation of the boat in shallow waters and during low speed operation. Furthermore, the diagonally disposed nature of the sponsons allows water to be thrust back underneath the boat instead of against the transom during a backing operation.

BRIEF DESCRIPTION OF THE DRAWINGS

Similar reference numerals refer to similar parts throughout the several views of the drawings.

DESCRIPTION OF THE PREFERRED EMBODIMENT

Figure 1:
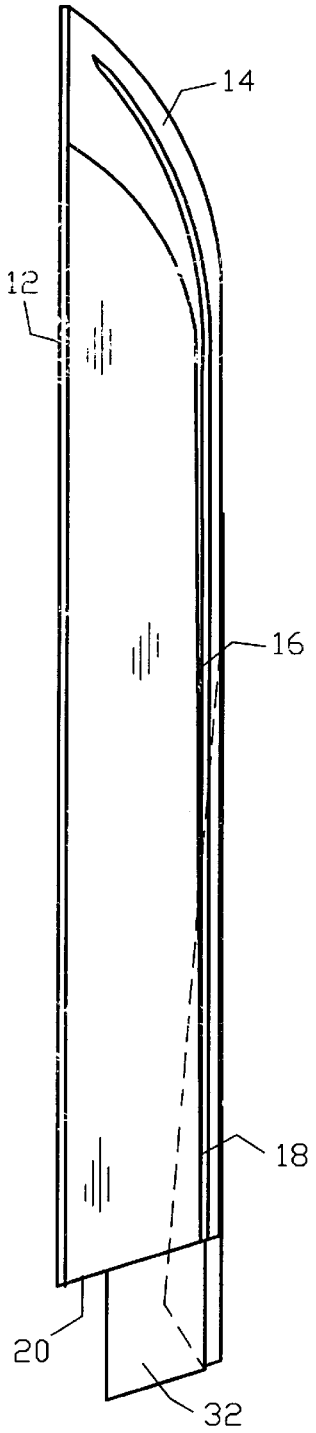
FIG. 1 is a side elevation of the tunnel-hulled boat of the present invention.
Figure 2:
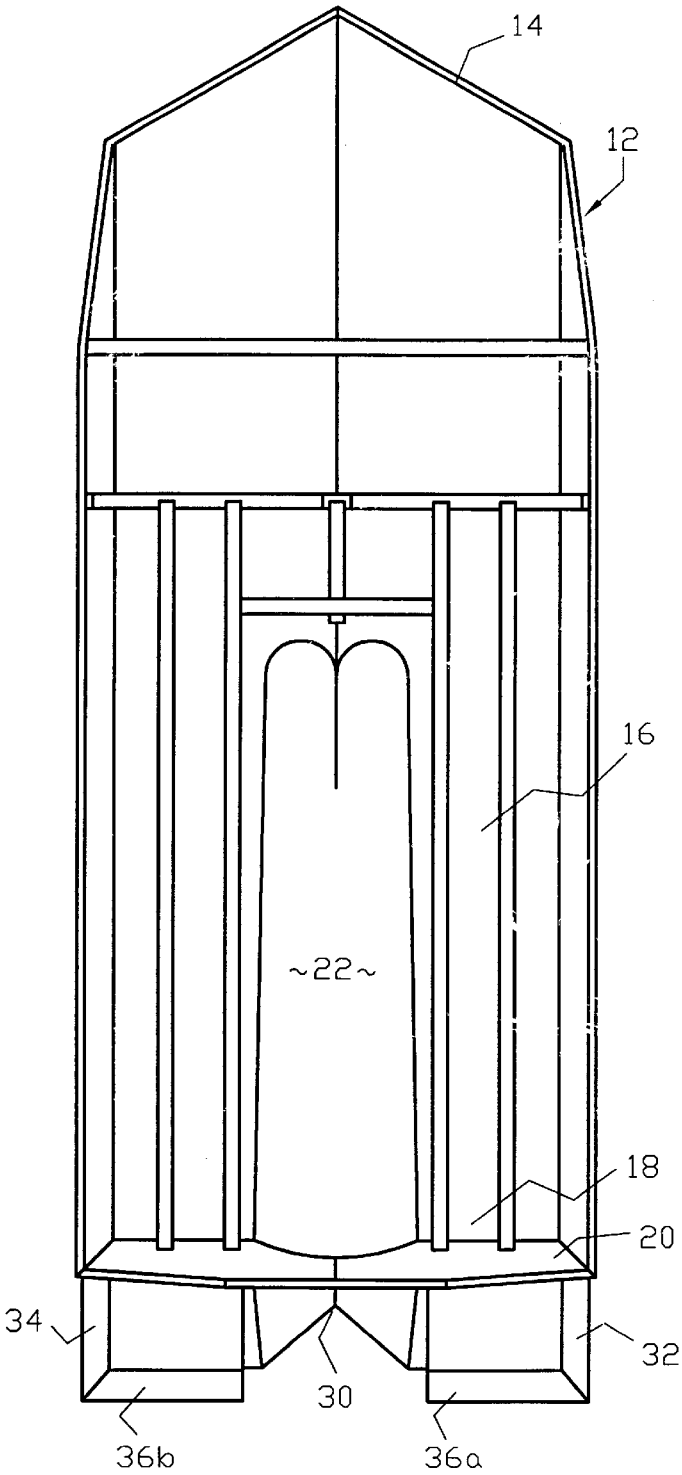
FIG. 2 is a top plan view of the tunnel-hulled boat.
Figure 3:
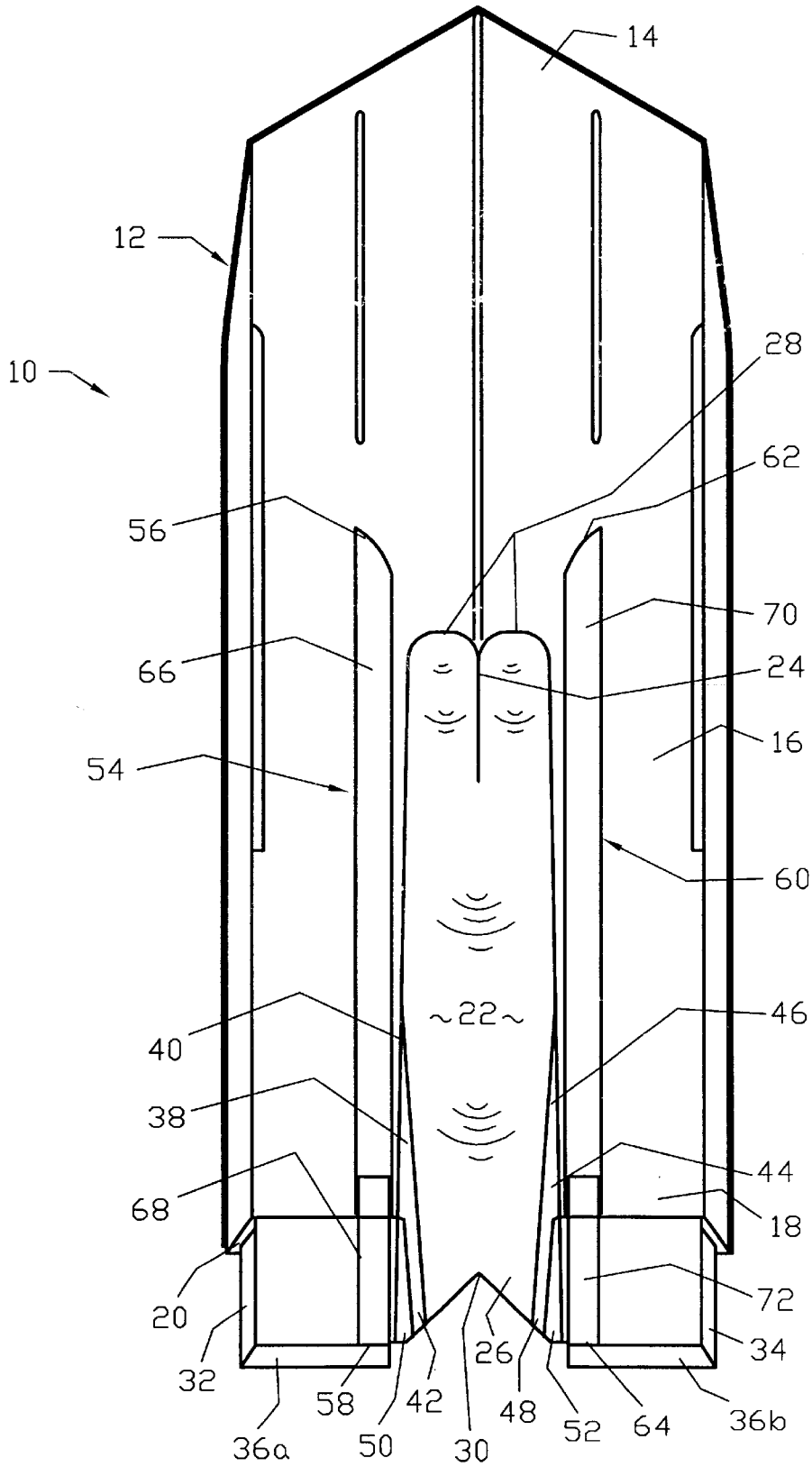
FIG. 3 is a bottom plan view of the tunnel-hulled boat.
Figure 4:
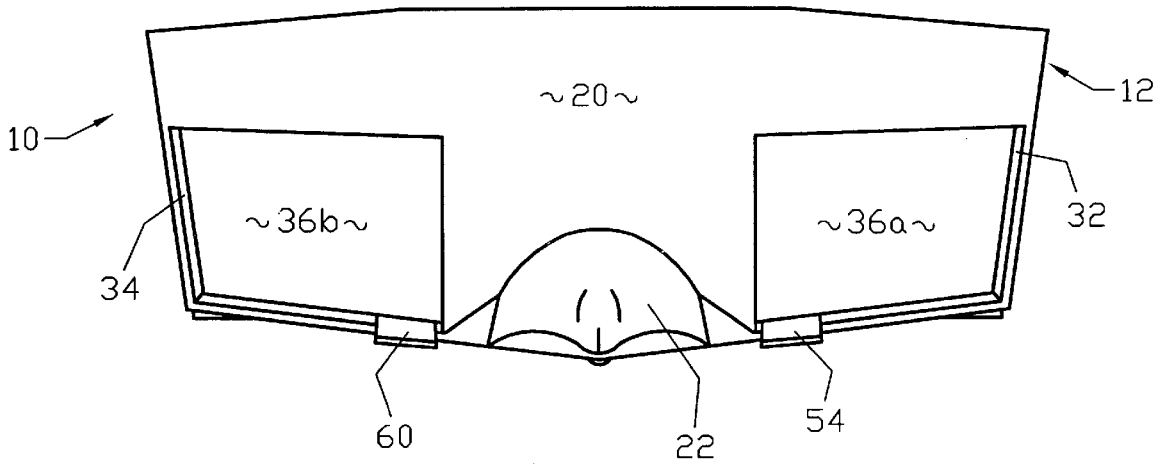
FIG. 4 is a rear elevation view of the tunnel-hulled boat.

Referring now to the drawings, it is seen that the tunnel-hulled boat of the present invention, generally denoted by reference numeral 10, is comprised of a hull 12 having a fore 14, an amidships 16 and an aft 18, as well as a top side and a bottom side. A transom 20 is attached to the hull 12 proximate the aft 18 in diagonal disposition relative to the amidships 16. A tunnel 22 having a first end 24 and a second end 26, is disposed within the hull 12 and extends from the amidships 16 to the aft 18. As seen, the first end 24 of the tunnel 22 is rounded with twin rounded entries 26, the body of the tunnel 22 being rounded with the depth of the tunnel 22 increasing from the first end 24 to the second end 26. The second end 26 of the tunnel has a notch 30 which is generally V-shaped. A first sponson 32 is attached to the transom 20 on one side of the tunnel 22 while a second sponson 34 is attached the transom 20 on the opposing side of the tunnel 22. The ends 36*a* and 36*b* of each sponson 32 and 34 respectively are disposed in diagonal orientation relative to the amidships 16. The first sponson 32 and the second sponson 34 have a combined buoyancy volume that is greater than the buoyancy volume of the tunnel 22. A motor (not illustrated) is attached to the transom 20 such that its drive propeller is disposed rearwardly of the tunnel 22

A first bevel 38, having a first end 40 and a second end 42, extends along on a first side of the tunnel 22, while a second bevel 44, having a first end 46 and a second end 48, is disposed along a second side of the tunnel 22. As seen, the diameter of the first bevel 38 increases from its first end 40 to its second end 42, while the diameter of the second bevel 44 also increases from its first end 46 to its second end 48. A third bevel 50 is disposed within the first bevel 38 proximate its second end 42 while a fourth bevel 52 is disposed within the second bevel 44 proximate its second end 48.

A first lifting strake 54, having a rounded first end 56 and a second end 58, extends along the bottom side of the hull 12 from the amidships 16 to the aft 18, while a second lifting strake 60, having a rounded first end 62 and a second end 64, extends along the bottom side of the hull 12 from the amidships 16 to the aft 18. As seen, the first strake 54 has a first section 66 and a second section 68 disposed on a different plane relative to the plane of the first section 66, and the second strake 60 has a first section 70 and a second section 72 disposed on a different plane relative to the plane of the first section 70 of the second lifting strake 60.

While the invention has been particularly shown and described with reference to an embodiment thereof, it will be appreciated by those skilled in the art that various changes in form and detail may be made without departing from the spirit and scope of the invention.

What is claimed is:

1. A tunnel-hulled boat comprising:

a hull having a top side, a bottom side, a fore, an amidships, and an aft;

a transom attached to the hull proximate the aft;

a single generally rounded tunnel, having a first side, a second side, a first end having twin rounded entries, and a second end, disposed within the hull and extending rearwardly from the amidships;

a first bevel, having a first end and a second end, disposed along the first side of the tunnel; and a second bevel, having a first end and a second end, disposed along the second side of the tunnel.

2. The tunnel-hulled boat as in claim 1 wherein the tunnel has a depth that increases from the first end of the tunnel to the second end of the tunnel.

3. The tunnel-hulled boat as in claim 1 wherein the cross-section of the first bevel increases from the first bevel's first end to the first bevel's second end and the cross-section of the second bevel increases from the second bevel's first end to the second bevel's second end.

4. The tunnel-hulled boat as in claim 1 wherein the second end of the tunnel is notched.

5. The tunnel-hulled boat as in claim 4 wherein the notch is generally V-shaped.

6. The tunnel-hulled boat as in claim 1 further comprising:

a third bevel disposed within the first bevel proximate the first bevel's second end; and a fourth bevel disposed within the second bevel proximate the second bevel's second end.

7. The tunnel-hulled boat as in claim 1 further comprising:

a first sponson having a first end attached to the transom proximate the second end of the first bevel and a second end; and a second sponson having a first end attached to the transom proximate the second end of the second bevel and a second end.

8. The tunnel-hulled boat as in claim 7 wherein the second end of the first sponson and the second of the second sponson end are each diagonally disposed relative to the amidships.

9. The tunnel-hulled boat as in claim 8 wherein the tunnel has a first buoyancy volume and the first sponson and the second sponson have a combined second buoyancy volume that is at least as great as the first volume.

10. The tunnel-hulled boat as in claim 8 further comprising:

a third bevel disposed between the first bevel and the first sponson; and a fourth bevel disposed between the second bevel and the second sponson.

11. The tunnel-hulled boat as in claim 1 further comprising:

a first lifting strake, having a first end and a second end, extending along the hull in spaced apart relation to the first side; and a second lifting strake, having a first end and a second end, extending along the hull in spaced apart relation to the second side.

12. The tunnel-hulled boat as in claim 11 wherein the first end of the first lifting strake and the first end of the second lifting strake are each rounded.

13. The tunnel-hulled boat as in claim 11 wherein the first lifting strake has a first section disposed on a first plane and a second section disposed on a second plane that is different relative to the first plane of the first lifting strake's first section and the second lifting strake has a first section disposed on a third plane and a second section disposed on a fourth plane that is different relative to the third plane of the second lifting strake's first section.

* * * * *